United States Patent [19]

Hopkins

[11] 4,205,851

[45] Jun. 3, 1980

[54] GAME BOARD

[76] Inventor: Ralph D. Hopkins, APO, New York, N.Y. 09155

[21] Appl. No.: 902,077

[22] Filed: May 2, 1978

[51] Int. Cl.[2] ..... A63F 3/00

[52] U.S. Cl. ..... 273/241; 273/285

[58] Field of Search ..... 273/241, 285

[56] References Cited

U.S. PATENT DOCUMENTS

| | | | |
|---|---|---|---|
| D. 192,147 | 12/1962 | Klamer et al. | D34/5 SS |
| 1,266,857 | 5/1918 | Recker | 273/285 |
| 1,549,611 | 8/1925 | Reisz | 273/285 |
| 2,722,425 | 11/1955 | Guzelle | 273/285 |
| 3,871,657 | 3/1975 | Lorenz et al. | 273/241 |

*Primary Examiner*—Richard C. Pinkham
*Assistant Examiner*—R. Carl Moy
*Attorney, Agent, or Firm*—Stein & Frijouf

[57] ABSTRACT

An improved board game is disclosed comprising a novel game board having a first, second and a third major board section. A first minor board section is interposed between the first and second major board sections, whereas a second minor board section is interposed between the second and third major board sections. Flexible hinges are provided to connect the major and minor board sections, enabling the game board to be folded along the flexible hinges. A first and a second elevational member respectively, project from the first and second major board sections of the game board. The first and second elevational members may take the form of a rotatable random selecting spinner device or a decorative ornament structure pertinent to the subject matter of the game. The first and second elevational members are established such that one of the elevational members is receivable in the other of the elevational members, enabling the board to be folded with the major board sections being substantially parallel.

8 Claims, 7 Drawing Figures

GAME BOARD

BACKGROUND OF THE INVENTION

1. Field of the Invention

This invention relates to amusement devices, and more particularly, to an improved game board.

2. Description of the Prior Art

The amusement art is saturated with various types of board games wherein a board token is moved around a path on a game board in accordance with the direction of some random selecting device. In many cases, tokens are moved about the game board path in accordance with the roll of dice or a spin of a rotatable selecting member or the drawing of a playing card. The subject matter and the object of each of these games varies widely, but the broad concept of this type of game is old in the art. The game boards incorporated in many of these games are hard sheet boards, having at least a single or plural flexible hinges, enabling the board to be folded and easily stored. The folding and storage of a sheet board presents no immediate problem in the art, but unfortunately these game boards lack any imaginative three-dimensional building structure.

The prior art has failed to present a game board incorporating a three-dimensional surface contour on the board while simultaneously being able to fold the board to eliminate the storage problem. For example, it would be desirable to have the surface contours of a mountain in a mountain climbing game or, a banked racetrack in a game board for a road racing game. Accordingly, there is a need in the prior art for a game board having three-dimensional surface contours in the form of projections which may be decorative ornamental structures or utility structures and which are pertinent to the subject matter of the game.

Therefore it is an object of this invention to provide an apparatus which overcomes the aforementioned inadequacies of the prior art devices and provides an improvement which is a significant contribution to the advancement of the game board art.

Another object of this invention is to provide a game comprising a game board having a first and a second major board section pivotably mounted relative to one another wherein each of the major board sections comprises a three-dimensional surface contour which surface contours are cooperable with one another upon folding the first and second major board portions.

Another object of this invention is to provide a game comprising a game board having a first, second and third major board sections and a first and a second minor board section interconnected by flexible hinge means. The game board is capable of being folded with the first, second and third major board sections being parallel to one another and each being perpendicular to the first and the second minor board sections.

Another object of this invention is to provide a game comprising a game board having a plurality of sections wherein a projection extending from a front surface of one of the major board sections is receivable in an aperture in the back surface of one of the other major board sections for operating as a locking mechanism for maintaining the game board in a folded condition.

Another object of this invention is to provide a game board having rotatable random selecting number means extending from one of the plurality of major board sections which is receivable in a recess in an elevational member of another of the plurality of major board sections, enabling the board to be folded with the major board sections essentially parallel to one another.

Other objects and a fuller understanding of this invention may be had by referring to the summary of the invention, the description and the claims, taken in conjunction with the accompanying drawings.

SUMMARY OF THE INVENTION

The invention comprises a board game including a game board having a first and a second major board section with a first minor board section interposed between the first and second board sections. The minor and major board sections are interconnected by a flexible hinge enabling the game board to be folded on the flexible hinge. A first and a second elevational member means respectively project from the first and second major board sections. The first and second elevational members are cooperable with one another, enabling the game board to be folded with the major board sections substantially parallel to one another and perpendicular to the minor board sections.

The board game may comprise a variety of subject matters and objects of the game. Indicia is printed upon the board sections and upon one of the elevational members defining a path of travel, for a plurality of game tokens. A rotatable random selecting means in one embodiment is secured to one of the board sections for providing random numbers for moving the plurality of game tokens along the path of travel. The rotatable random selecting means in the preferred form, includes a rotatable disc having an upwardly extending handle, which handle is receivable in a cutout in the elevational member on the adjacent major board section.

In another embodiment of the invention, the game board comprises a first, second and a third major board section. In this embodiment, a first minor board section is interposed between the first and second major board sections, whereas a second minor board section is interposed between the second and third major board sections. First and second elevational members extending from the first and second major board sections, are established with one of the elevational members being receivable in the other of the elevational members. This configuration enables the game board to be folded with the first, second and third major board sections substantially parallel to one another.

The first elevational member may comprise a region of high elevation and a region of low elevation. The region of low elevation is adapted for receiving the second elevational member of the second major board section. The region of low elevation may be formed as a tapering of the first elevational member from the region of high elevation to the first major board section. In the alternative, the region of low elevation may be formed as a cutout in the first elevational member extending to the first major board section. In another embodiment, the first and second elevational members may each comprise a plurality of elevational members such as decorative ornamental structures pertinent to the subject matter of the game.

A third elevational member means is provided for projecting from the third major board section. In this embodiment, an aperture is defined in the first major board section for receiving the third elevational member means upon folding the game board. The aperture extends into the first major board section from a side opposite the side having the first elevational member.

Accordingly, the third elevational member locks the game board into a folded position upon insertion of the third elevational member into the aperture. In this arrangement, the top surface of the first major board section cooperates with the top surface of the second major board section whereas the top surface of the third major board section cooperates with the bottom surface of the first major board section.

This invention accordingly comprises an apparatus possessing the features, properties and the relation of elements which will be exemplifed in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
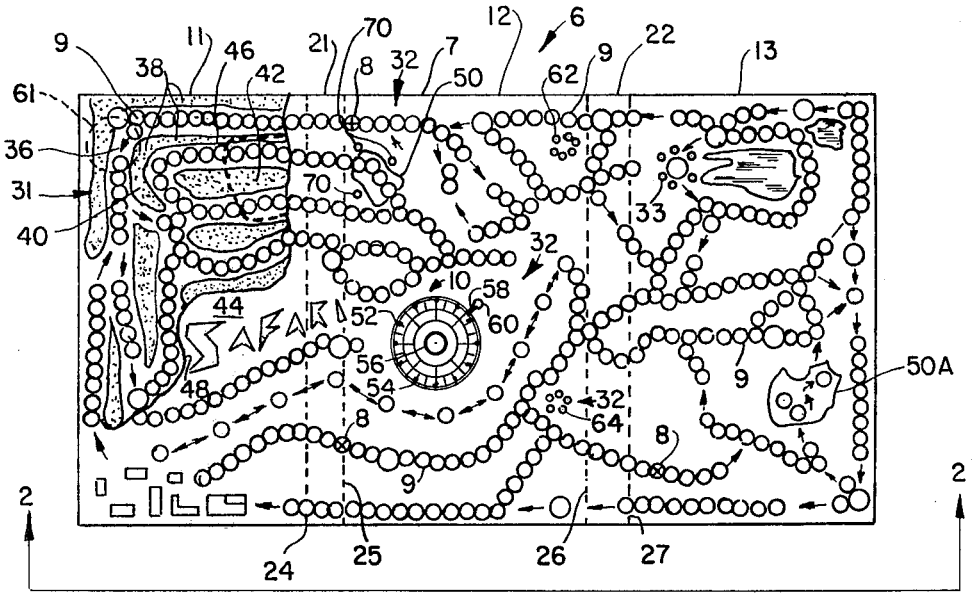
FIG. 1 is an elevational view of a game comprising a novel game board shown in the opened position on a substantially horizontal surface.

FIGS. 1–5 show various views of a game 6 comprising a game board 7 and a plurality of game tokens 8 for movement along a game path 9 in accordance with random units of movement generated by a random selector means 10. Although the invention is shown incorporated into a game relating to a safari adventure, it should be understood that the invention is applicable to games of various subject matters and should not be limited by this specific example. The random selector 10 is included in this specific example of the invention although it is not a mandatory requirement for the practice of this invention.

Figure 3:
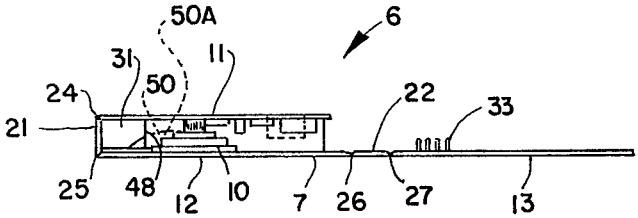
FIG. 3 is a side elevational view of the game board shown in FIGS. 1 and 2 wherein the first major board section is folded upon the second major board section.
Figure 4:
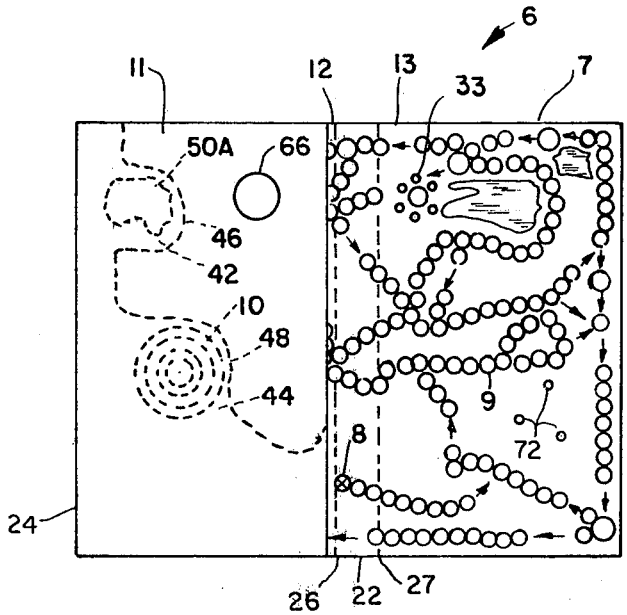
FIG. 4 is a top elevational view of the folded game board shown in FIG. 3.
Figure 5:
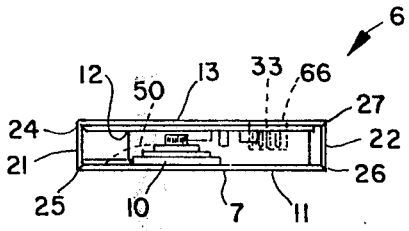
FIG. 5 is a side elevational view of the game board shown in FIGS. 1–4 shown in the folded position.

More specifically, the novelty in the game 6 resides in the game board 7 having a first major game board section 11, a second major board section 12, and a third major game board section 13. A first minor game board section 21 is interposed between the first and second game board sections 11 and 12 whereas a second minor game board section 22 is interposed between the second major game board section 12 and the third major game board section 13. Flexible means, shown as flexible hinges 24–27 enable the game board 7 to be folded along the flexible hinges 24–27 as shown in FIGS. 3–5.

An important aspect of the invention resides in plural elevational member means projecting from the major board sections of the game board to furnish the game board with a three-dimensional contour of items pertinent to the theory or the subject matter of the game. The elevational member means may in some instances, comprise a decorative or ornamental structure whereas in other instances the elevational member means may comprise a projection having utility within the game. First through third elevational member means 31–33 are included in this specific example of the safari game, but it should be understood that the elevational member means may be adapted for different subject matters of different games.

The first elevational member means 31 comprises a land contour having hills 36 and dense forest growth 38, which is traversed by the game path 9. The first elevational member means 31 comprises a region of high elevation 40 and plural cutout regions or regions of low elevation 42 and 44. The region of low elevation 42 comprises a tapering from contour line 46 from the high elevational region 40 to the game board 11. The second low elevational region 44 comprises drop-off or cut-out region along contour line 48 from the region of high elevation 40 to the region of low elevation which is the level of game board 11. The regions 42 and 44 are adapted to respectively receive the second elevational member means 32, comprising a mountain 50 and the random selector 10. The random selector in this embodiment is shown as a rotatable disc 52 having a plurality of pegs 54 equally distributed around the circumference of the disc 52. An upwardly extending handle 56 is mounted for rotating the disc 52. A flexible wiper finger 58 is secured on rod 60 for cooperation with the upstanding pegs 54 for selecting a number (not shown) adjacent the space between any two pegs to randomly generate units for moving the tokens 8 along the game path 9. The second elevational member means 32 further comprise ornamental three-dimensional contours, for example, native villages 62 and 64. Similarly, the third elevational member means 33 represents a native village. However, the third elevational member means 33 is cooperable with an aperture 66 located in the bottom surface of the first major board section 11 as will be hereinafter described.

Figure 6:
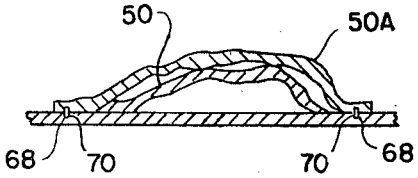
FIG. 6 is a side sectional view of a portion of the second major game board section illustrating a novel elevational member means.
Figure 7:
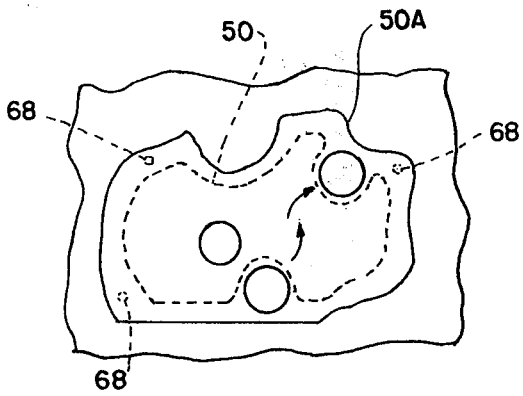
FIG. 7 is a top elevational view of the novel elevational member means shown in FIG. 6.

FIGS. 6 and 7 further illustrate the mountain 50 comprising a fixed mountain component 50 and a removable mountain component 50A. The movable mountain component 50A is a hollow shell for receiving the fixed mountain component 50 therein. A plurality of pins 68 fixed to the movable mountain component 50A are frictionally received in apertures 70 within the second major game board section 12. The movable mountain component 50A may be removed from the second major game board section 12 and inserted into aperture 72 in the third major game board section 13 as shown in FIG. 1. In this position, the game board 7 is ready for play.

Figure 2:
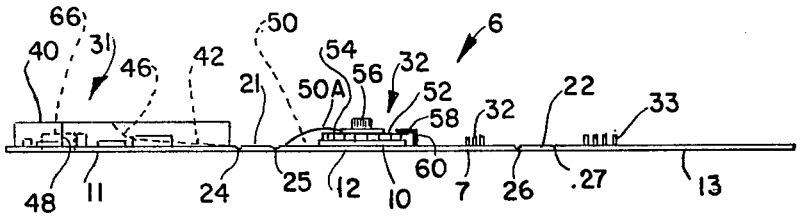
FIG. 2 is a side elevational view along line 2—2 in FIG. 1 of the novel game board.

FIG. 2 is a side elevational view of the game board 7 in the open position as shown in the top elevational view of FIG. 1. The folding of the board 7 is illustrated in FIGS. 3–5. Initially, the movable mountain component 50A is removed from the third major game board section 13 and is rotated one hundred and eighty degrees for insertion of pins 68 in aperture 70 in the second game board section 12. Accordingly, the nesting of mountain components 50 and 50A conserves space and requires only a single low elevation region 42. The first major board section 11 is then folded on hinges 24 and 25 such that the first major board section 11 is substantially parallel to the second major board section 12. It should be appreciated that the cutout 42 of the first elevational member 31 receives mountain 50A and 50B whereas the cutout 44 of the first elevational member 31 receives projection 10 as shown more fully in FIG. 4. A third low elevational region 61 of the first elevational member 31 receives projection 62. The aperture 66 is shown extending into the rear surface of the first major board section 11.

FIG. 5 illustrates the final step of the folding of the board 7. The third major board section 13 is hinged on hinges 26 and 27 such that the major board section 11–13 are substantially parallel to one another and substantially perpendicular to the minor board sections 21–22. The third projection member means 33 is received by aperture 66 of the first major board section 11 for locking the board 7 in the closed position. Accordingly the third elevational member means 33 provides both ornamentation and utility for this invention. The unique arrangement of the major and minor boards sections in conjunction with the flexible hinges and cooperable elevational members which result in the novel game board heretofore described.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention.

Now that the invention has been described:

What is claimed is:

1. A board game, comprising in combination:

a game board comprising a first, second and a third major board section each having a playing surface and a base surface;

said game board further comprising a first minor board section interposed between said first and second major board sections and a second minor board section interposed between said second and third major board sections;

flexible means interconnecting said major and minor board sections enabling said game board to be folded along said flexible means;

a first, second and a third elevational member means respectively projecting from said playing surfaces of said first, second and third major board sections of said game board;

said third elevational member means comprising a permanent third elevational member and a removable third elevational member having a three dimensional contour consistent with the theme of the game for enhancing the appearance of the game theme on said game board;

means establishing one of said first and second elevational member means to be at least partially receivable in the other of said first and second elevational member means enabling said game board to be folded with said first major board section being substantially parallel to said second major board section;

aperture means defined in said base surface of said first game board section for receiving said permanent third elevational member extending from said playing surface of said third game board section upon said third game board section being folded substantially parallel to said first game board section;

said permanent third elevational member locking said game board in a folded position upon insertion of said permanent third elevational member into said aperture means;

means for mounting said removable third elevational member at a location on said third game board section for providing a three dimensional contour at said location when said removable member is mounted thereat and for providing a substantially flat game board surface at said location upon removal of said removable member;

means for mounting said removable member to one of said first and second game board sections to cooperate with said first and second elevational members for storing said removable member when said game board is in the folded position; and said removable member being hollow for receiving therein at least a portion of one of said first and second elevational members during storage of said removable member thereon.

2. A game as set forth in claim 1, wherein said minor game board sections are established substantially perpendicular to said major board sections upon folding said game board.

3. A game as set forth in claim 1, wherein said first elevational member means comprises a region of high elevation and a region of low elevation; and said region of low elevation receiving said second elevational member means therein.

4. A game as set forth in claim 3, wherein said region of low elevation comprises a tapering of said first elevational member means from said region of high elevation to said first major board section.

5. A game as set forth in claim 3, wherein said region of low elevation comprises a cutout in said first elevational member means extending to said first major board section.

6. A game as set forth in claim 1, wherein one of said first and second elevational member means comprises a rotatable random selecting means.

7. A game as set forth in claim 1, including indicia defined upon said major board sections and upon at least one of said elevational member means defining a path of travel for a plurality of game tokens.

8. A game as set forth in claim 1, wherein each of said first and second elevational member means comprises a plurality of elevational members.

* * * * *